US012716255B1

(12) United States Patent
O'Hara et al.

(10) Patent No.: US 12,716,255 B1
(45) Date of Patent: Aug. 25, 2026

(54) APPARATUS AND METHOD FOR CLEANING A SURFACE WITH A FLUID

(71) Applicants: Patrick O'Hara, Merritt Island, FL (US); Christopher Zalapi, Orlando, FL (US)

(72) Inventors: Patrick O'Hara, Merritt Island, FL (US); Christopher Zalapi, Orlando, FL (US)

( * ) Notice: Subject to any disclaimer, the term of this patent is extended or adjusted under 35 U.S.C. 154(b) by 364 days.

(21) Appl. No.: 18/234,740

(22) Filed: Aug. 16, 2023

Related U.S. Application Data

(60) Provisional application No. 63/398,372, filed on Aug. 16, 2022.

(51) Int. Cl.
*E04H 4/16* (2006.01)

(52) U.S. Cl.
CPC ..... *E04H 4/169* (2013.01); *E04H 4/1618* (2013.01); *E04H 4/1636* (2013.01)

(58) Field of Classification Search
CPC ..... E04H 4/16; E04H 4/1654; E04H 4/1636; B01D 24/4684
See application file for complete search history.

(56) References Cited

U.S. PATENT DOCUMENTS 3,707,737 A * 1/1973 Brower ..... E04H 4/1618 15/409
4,361,282 A * 11/1982 DiVito ..... B05B 1/3405 134/22.12
5,018,890 A * 5/1991 May ..... E04H 4/1281 15/98
5,133,503 A 7/1992 Giordano et al.
5,655,246 A 8/1997 Chang
8,434,182 B2 5/2013 Horvath et al.
9,080,342 B2 * 7/2015 Fischmann ..... E04H 4/1645
9,278,381 B2 * 3/2016 Porat ..... E04H 4/1663
9,745,767 B2 8/2017 Renaud et al.
2014/0115796 A1 * 5/2014 Sebor ..... E04H 4/1654 15/1.7
2016/0273238 A1 * 9/2016 Heffernan ..... E04H 4/1618
2017/0002581 A1 * 1/2017 Matthews ..... E04H 4/1645
2018/0179772 A1 * 6/2018 Roumagnac ..... E04H 4/16
2019/0055745 A1 * 2/2019 Lambourn ..... E04H 4/1663
2022/0233975 A1 * 7/2022 Franck ..... B01D 24/4673

* cited by examiner

*Primary Examiner* — Michael D Jennings
(74) *Attorney, Agent, or Firm* — John Rizvi; John Rizvi, P.A.—The Patent Professor®

(57) ABSTRACT

The present invention pertains to an apparatus designed for efficient cleaning of submerged surfaces, such as those in swimming pools, fountains, and similar aquatic features. This apparatus incorporates a unique combination of a radial flow turbine assembly, which produces a pulsating flow of fluid, and one or more nozzles that discharge a spray of the fluid. The pulsating nature of the spray offers enhanced cleaning efficacy by utilizing the kinetic energy of intermittent fluid bursts. Additionally, the housing of the apparatus is inspired by hydrodynamic principles, reducing resistance during movement in water and potentially mimicking structures seen in aquatic organisms like the hammerhead shark. This design ensures smooth navigation across varied surfaces and obstructions. Optional features such as wheels and a pole connection further augment its versatility, making it a comprehensive solution for cleaning submerged surfaces.

20 Claims, 7 Drawing Sheets

APPARATUS AND METHOD FOR CLEANING A SURFACE WITH A FLUID

FIELD OF THE INVENTION

The field of this invention relates to surface cleaning devices, and more specifically, to apparatuses designed for cleaning submerged surfaces such as those found in swimming pools, fountains, and other aquatic features, capitalizing on the unique capabilities of pulsating fluid sprays.

BACKGROUND OF THE INVENTION

Submerged surfaces in swimming pools, fountains, and similar structures often become host to debris, algae, calcium deposits, and other unwanted contaminants over time. These unwanted accumulations can adversely affect the appearance and function of these water features, and moreover, compromise the quality of the contained water. Traditionally, these submerged surfaces are cleaned through manual scrubbing with brushes, poles, and sometimes even chemical cleaning agents. While effective to an extent, these methods are laborious, time-intensive, and might lead to uneven cleaning results. In addition, the use of chemicals can alter the water balance, potentially endangering aquatic life and pool users.

Over the years, to mitigate these challenges, the market has seen the introduction of various automated and semi-automated pool cleaners. Such devices typically employ wheels or tracks for movement and use mechanisms like suction, brushes, or water jets for cleaning. However, they can be expensive, bulky, and may still not provide thorough cleaning. Among the promising solutions is the concept of pulsating fluid sprays. Unlike continuous water streams, pulsating sprays release intermittent bursts of fluid, potentially providing more effective cleaning by leveraging the kinetic energy of the pulsating water.

The design and movement mechanism of the cleaning apparatus are other crucial aspects. Many automated cleaners with wheels or tracks can get stuck or fail to navigate complex surfaces efficiently. On the other hand, the design principles from aquatic biology, especially from creatures like sharks, demonstrate how specialized body structures can offer minimal resistance and superior maneuverability in water. The unique structure of a hammerhead shark's head, for instance, allows it to move fluidly with minimal resistance.

Despite the advancements in submerged surface cleaning technologies, significant limitations persist in the existing solutions. There remains an evident demand for a device that harnesses the advantages of pulsating fluid sprays and integrates hydrodynamic, possibly bio-inspired, design principles. Such an apparatus would ideally reduce manual interventions and handle varied submerged surfaces, from pool tiles to elaborate fountain designs, ensuring consistent, comprehensive cleaning.

SUMMARY OF THE INVENTION

The present invention is directed to a convenient and labor-saving apparatus that is capable of quickly and efficiently cleaning a surface with a fluid. The apparatus may include a housing, a fluid inlet configured to receive a flow of the fluid from a source of the fluid, a radial flow turbine assembly configured to receive the flow of the fluid from the fluid inlet and produce therefrom a pulsating flow of the fluid, one or more fluid channels each configured to receive the pulsating flow of the fluid from the radial flow turbine assembly, and one or more nozzles each configured to receive the pulsating flow for the fluid from a corresponding one of the one or more fluid channels and discharge a spray of the fluid from the housing.

In a first implementation of the invention, an apparatus for cleaning a surface with a fluid includes a housing, a fluid inlet configured to receive a flow of the fluid from a source of the fluid, a radial flow turbine assembly configured to receive the flow of the fluid from the fluid inlet and produce therefrom a pulsating flow of the fluid, one or more fluid channels each configured to receive the pulsating flow of the fluid from the radial flow turbine assembly, and one or more nozzles each configured to receive the pulsating flow for the fluid from a corresponding one of the one or more fluid channels and discharge a spray of the fluid from the housing.

In a second aspect, the apparatus may include wheels rotatably secured to the housing and configured to support the housing on the surface such that the discharge of the spray from the one or more nozzles is directed toward the surface.

In another aspect, the apparatus may include a pole connection configured to releasably couple an elongated pole to the housing for manual movement thereof.

In another aspect, the radial flow turbine assembly may include a directional aperture plate configured to direct the flow of the fluid received from the fluid inlet connection tangentially, a radial flow turbine comprising distinct chambers configured to receive the flow of the fluid from the directional aperture plate and rotate about a central axis of rotation in response to receiving the flow of the fluid from the directional aperture plate, and a turbine chamber within the housing configured to store the radial flow turbine therein, the turbine chamber having apertures in a wall thereof each coupled to a corresponding one of the fluid channels and configured to provide passage of the fluid therethrough. The radial flow turbine may be configured such that at least a first of the apertures of the turbine chamber is blocked by the radial flow turbine and at least a second of the apertures of the turbine chamber is open to receive the fluid at any point of rotation of the radial flow turbine about the central axis of rotation.

In another aspect, the radial flow turbine may include a segmented, circular wall having a center point thereof corresponding with the central axis of rotation of the radial flow turbine, wherein the circular wall is configured to intermittently block the apertures of the turbine chamber adjacent thereto as the radial flow turbine rotates.

In another aspect, the directional aperture plate may include a plurality of spaced apart flow holes configured to provide passage therethrough for the fluid, the flow holes having central, longitudinal axes oriented tangential to the flow of the fluid received thereby.

In another aspect, the fluid inlet may be configured to releasably couple with a hose.

In another aspect, the housing may have a hydrodynamic exterior shape configured to produce a force in a direction of the discharge of the spray from the one or more nozzles in response to fluid flow over the housing.

In another aspect, the hydrodynamic exterior shape of the housing may mimic an exterior shape of a head of a hammerhead shark.

In another aspect, the apparatus may include at least two of the one or more nozzles.

In another aspect, the apparatus may be configured to clean surfaces of a pool containing water therein.

In a second implement of the invention, a method for cleaning a surface with a fluid includes locating an apparatus on the surface, providing a flow of the fluid from a source of the fluid to a fluid inlet of a housing of the apparatus, directing the flow of the fluid from the fluid inlet to a radial flow turbine assembly and producing a pulsating flow of the fluid therewith, directing the pulsating flow of the fluid to one or more nozzles of the housing through fluid channels fluidically coupling the radial flow turbine assembly, and discharging the pulsating flow of the fluid as a spray from the housing via the one or more nozzles such that the spray contacts the surface.

In another aspect, the method may include manually moving the apparatus relative to the surface with an elongated pole coupled to the housing.

In another aspect, moving the apparatus may include rolling the housing on wheels thereof that are in contact with the surface.

In another aspect, the method may include releasably coupling the fluid inlet to the source with a hose.

In another aspect, the method may include moving the apparatus relative to the surface, wherein the housing of the apparatus and the surface are submerged in water, wherein movement of the housing through the water produces a force in a direction of the discharge of the spray from the one or more nozzles due to a hydrodynamic exterior shape of the housing.

In another aspect, the method may include producing the housing to have the hydrodynamic exterior shape, wherein the hydrodynamic exterior shape mimics an exterior shape of a head of a hammerhead shark.

In another aspect, the method may include discharging the spray from at least two of the one or more nozzles.

In another aspect, the surface may be a portion of a swimming pool containing water therein.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
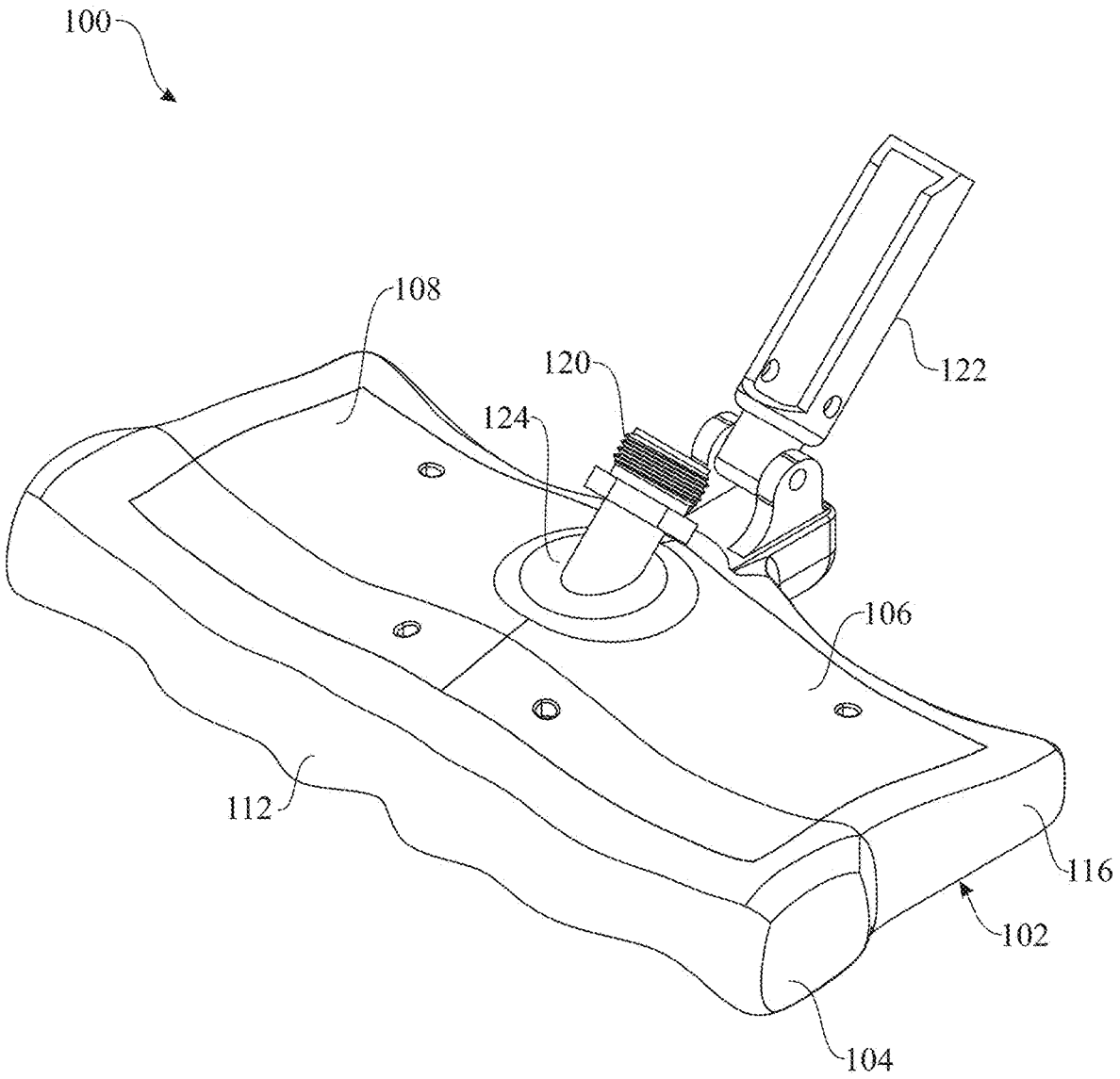
FIG. 1 presents a top perspective view of an apparatus for cleaning submerged surfaces in accordance with an embodiment of the present invention.
Figure 2:
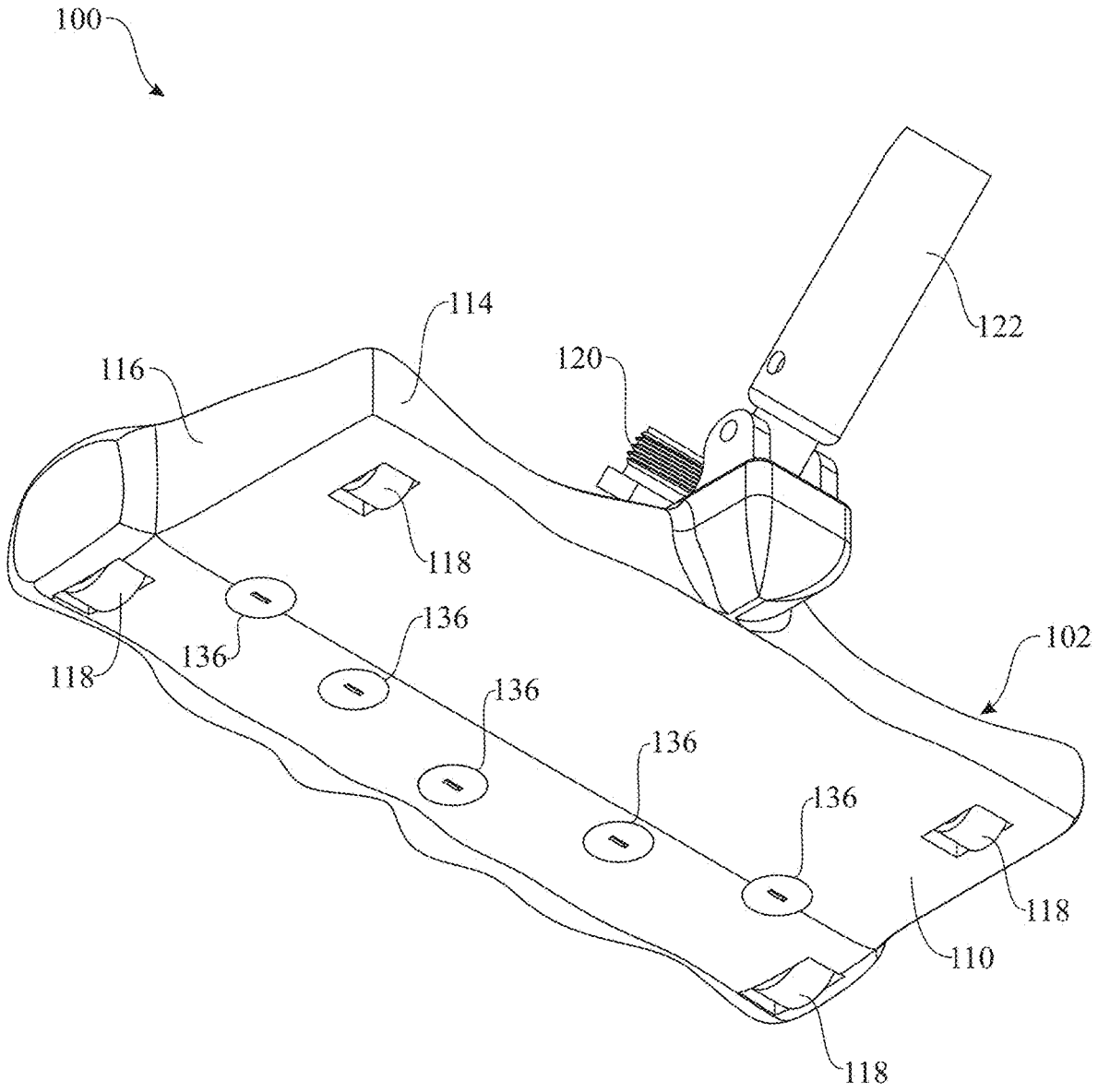
FIG. 2 presents a bottom perspective view of the apparatus of FIG. 1.
Figure 3:
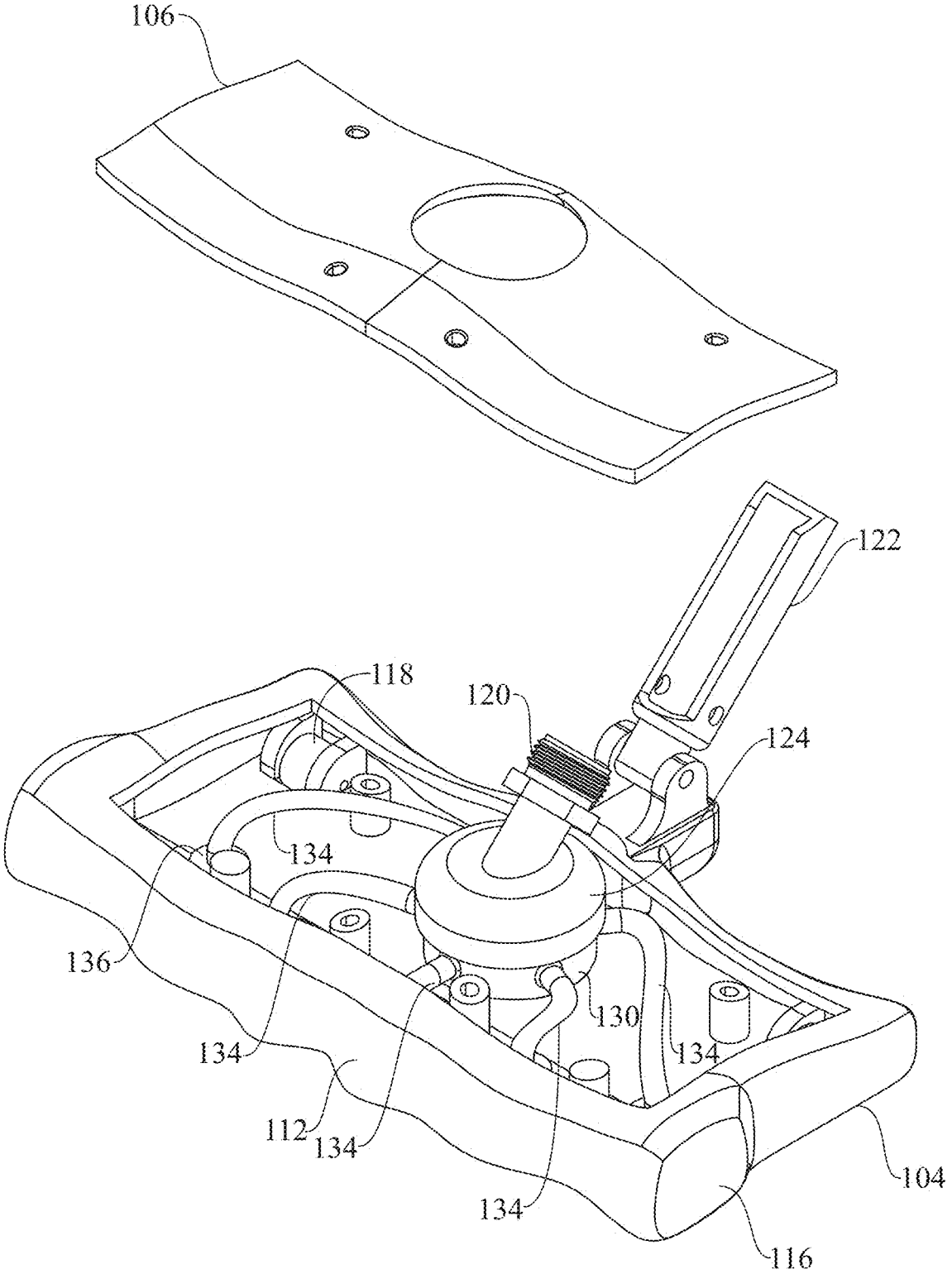
FIG. 3 presents a top perspective view of apparatus of FIG. 1 with a cover thereof removed to expose internal components.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a convenient and economical apparatus that is capable of cleaning a surface with a fluid in an efficient and labor-saving manner. Although the apparatus is primarily discussed in reference to cleaning surfaces of commercial and/or residential swimming pools containing pool water, various other applications are foreseeable and within the scope of the invention. Particularly notable, but nonlimiting, examples include fountains and other water features that include submerged surfaces.

Referring initially to FIGS. 1 through 6, an exemplary apparatus 100 is presented in accordance with various embodiments. The apparatus 100 includes a housing 102 suitable for use in cleaning submerged surfaces of a commercial and/or residential pool or other water feature. For convenience, the housing 102 of the apparatus 100 will be referred to herein as including a top 108, a bottom 110, a front 112, a rear 114, and a pair of sides 116 corresponding to an orientation represented in FIG. 1. However, these terms are merely intended to promote the description of the apparatus 100 herein and are not intended to limit the construction, functions, or use of the apparatus 100 in any manner.

The housing 102 includes a base 104 having front, rear, side, bottom, and partial top walls that define a compartment therebetween. The partial top wall has an opening therein that provides access to the compartment. The housing 102 includes a cover 106 configured to be secured to the base 104 to close the opening of the partial top wall of the base 104. The cover 106 may be secured to the base 104 by being located on support members extending from interior surfaces of the bottom wall of the base 104 such that holes in the cover 106 are axially aligned with holes of the support members. Once aligned, fasteners may be inserted into the holes to secure the cover 106 to the base 104.

Wheels 118 are rotatably coupled to the housing 102 and configured to support the housing 102 on a surface such that the housing 102 may be rolled along the surface. In the example represented in the figures, the wheels 118 are rotatably secured within the housing 102 and partially exposed from the bottom of the housing 102.

The housing 102 includes a pole connection 122 fixed to or adjacent the rear 114 of the apparatus 100 that is configured to releasably couple with an elongated pole or other member suitable for providing a handgrip for manually moving the housing 102. The pole connection 122 includes a pivoting joint configured to allow the pole attached to the pole connection 122 to pivot, relative to an axis of rotation of the pivoting joint. Alternative, the pole connection 122 may be rigidly fixed relative to the housing 102 or may be coupled to the housing 102 with another type of joint such as a swivel joint. In various embodiments, the pole connection 122 is configured to releasably coupled with a standard swimming pool pole of the type commonly used for various pool accessories such as brushes, leaf skimmers, nets, rakes, and the like.

A fluid inlet 120 is provided that is configured to receive a flow of the fluid from a source of the fluid external to the housing 102 and provide such flow of the fluid to certain components within the compartment of the housing 102. Specifically, the fluid is received within the fluid inlet 120 and directed to a radial flow turbine assembly. The radial flow turbine assembly is configured to produce a pulsating flow of the fluid and direct the pulsating flow through fluid channels 134 to nozzles 136. The nozzles 136 are each configured to discharge a spray of the fluid from the bottom of the housing 102 such that the spray contacts and preferably cleans debris, algae, and other surface contaminants from the surface. In some embodiments, the nozzles 136 may be configured to produce overlapping sprays to promote coverage of the surface therewith.

Figure 4:
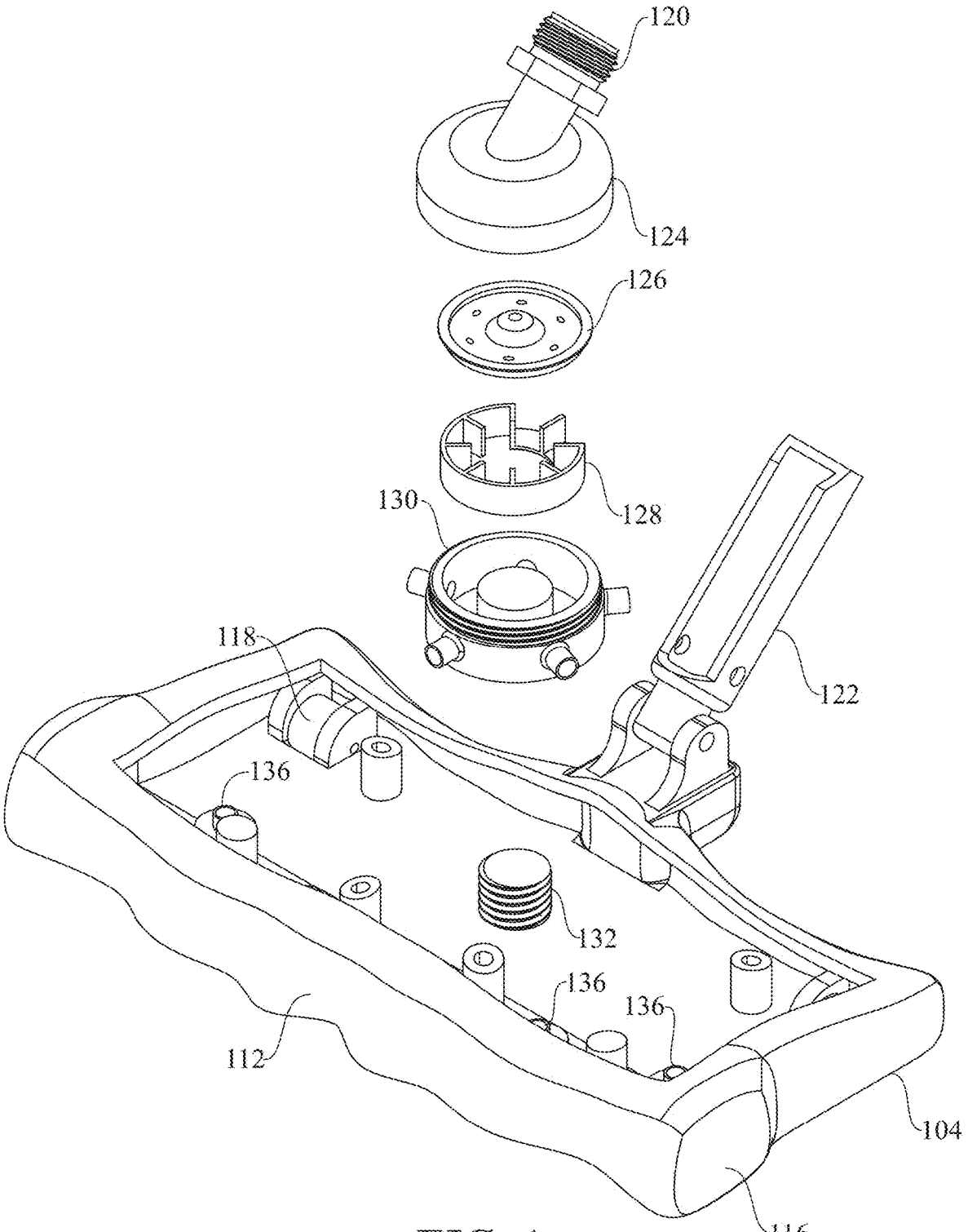
FIG. 4 presents a top perspective, expanded view of the apparatus of FIG. 1.
Figure 5:
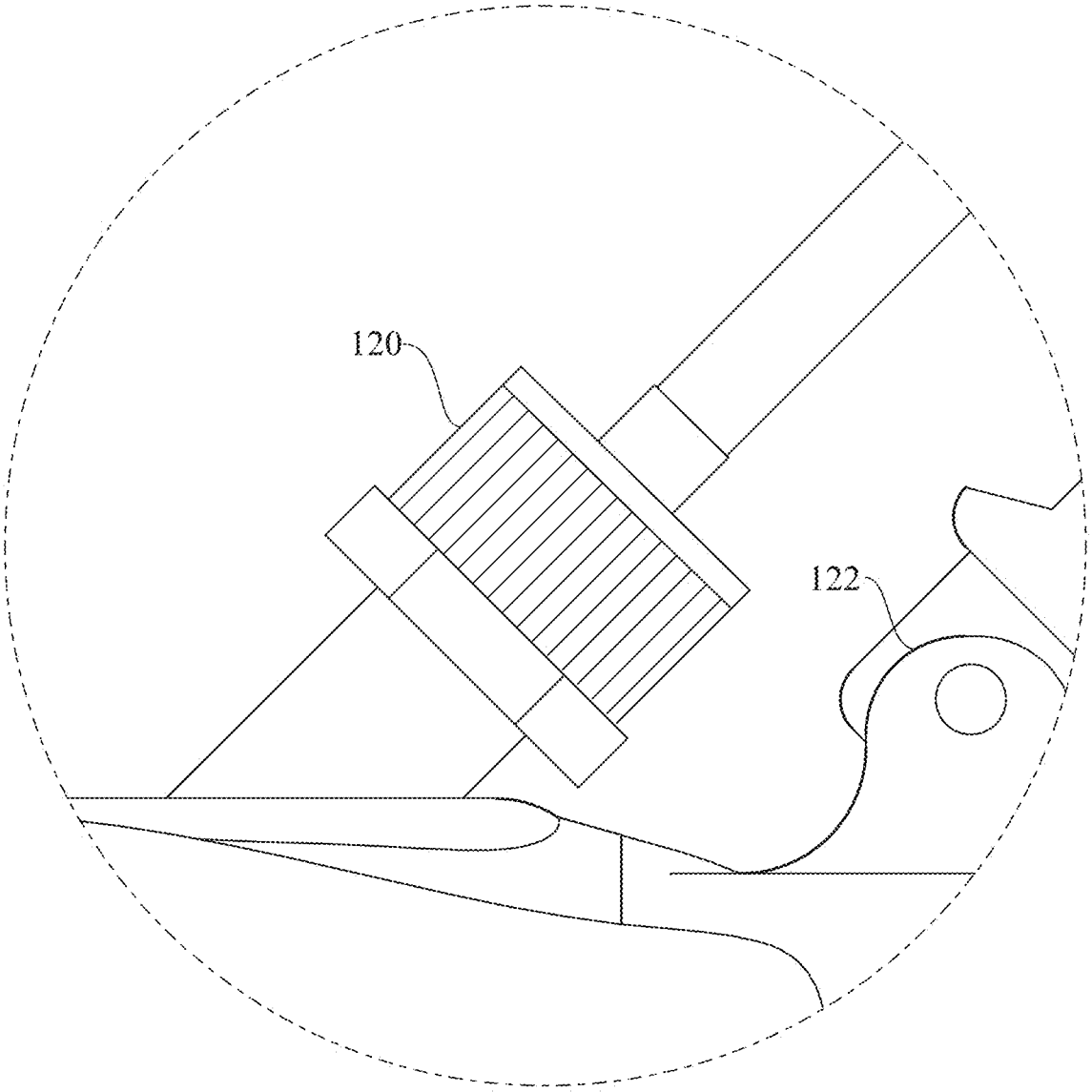
FIG. 5 presents an isolated, side view of a fluid inlet of the apparatus of FIG. 1.
Figure 6:
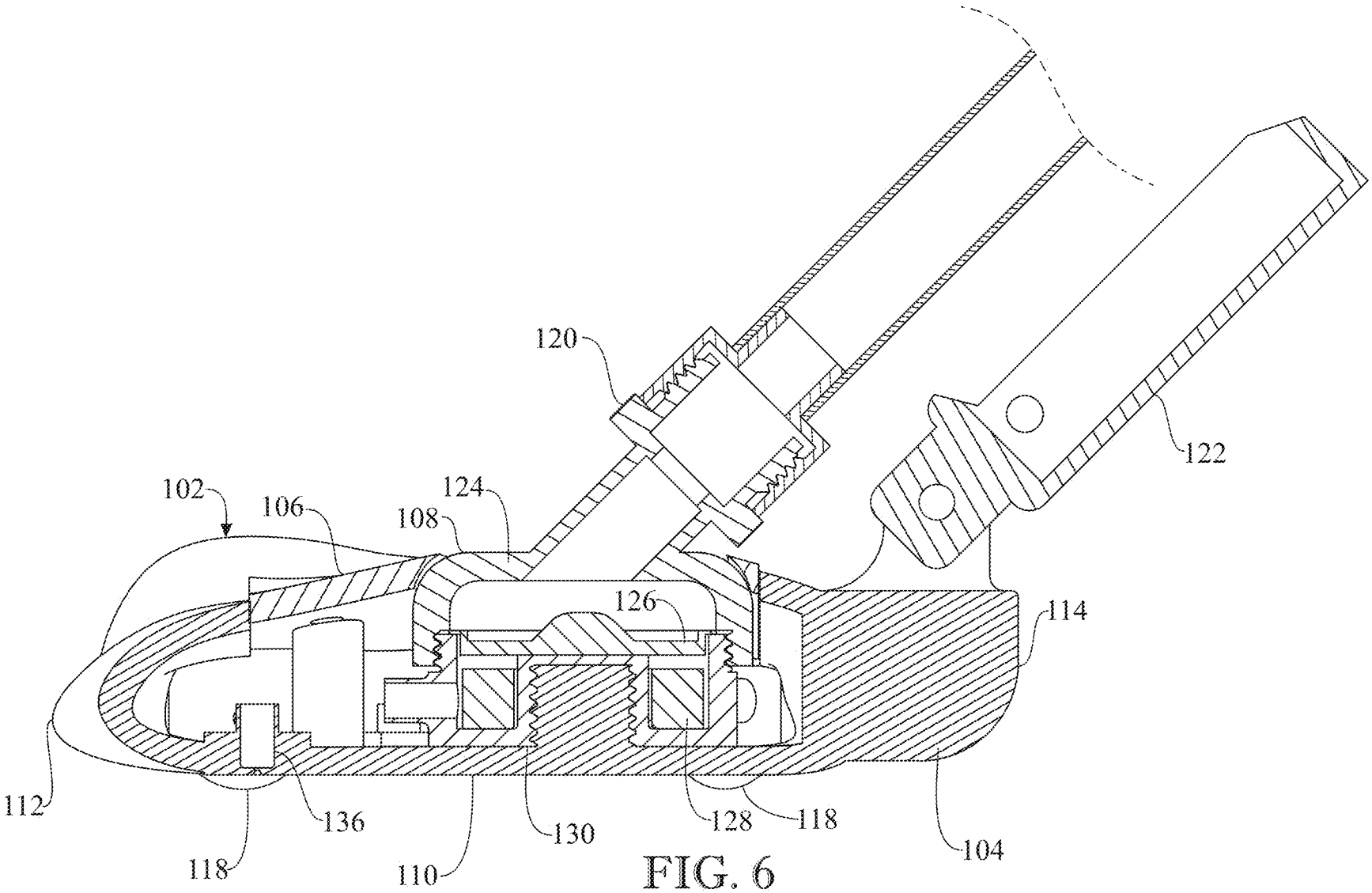
FIG. 6 presents a cross-sectional view of the apparatus of FIG. 1.

As represented in FIGS. 4 and 6, the radial flow turbine assembly may include a cap 124 comprising the fluid inlet 120, a directional aperture plate 126, a radial flow turbine 128, and a turbine chamber 130. The turbine chamber 130 includes a circular sidewall, a base wall, and an opening opposite the base wall. Outlet apertures are provided in the sidewall that are configured to provide passage of the fluid therethrough. The base wall includes a recess formed in a protrusion extending from the base wall of the turbine chamber 130. The recess includes internal threads configured to threadedly mate with exterior threads on a threaded member protruding into the compartment of the housing 102 from the bottom wall of the base 104. In this manner, the turbine chamber 130 may be releasably fixed to the threaded member and thereby secured in a fixed position within the compartment of the housing 102. The cap 124 includes a dome-shaped body with the fluid inlet 120 fixed at an upper end thereof. Interior surfaces of the dome-shaped body define a concave recess within the cap 124 that is in fluidic communication with the fluid inlet 120 via a passage therethrough. The cap 124 may be threadedly coupled to the turbine chamber 130 to enclose the opening thereof. The interior surfaces of the cap 124 and the turbine chamber 130 define a chamber for housing the directional aperture plate 126 and the radial flow turbine 128.

The radial flow turbine 128 is configured to be located in a cavity defined between the sidewall and protrusion of the turbine chamber 130 such that the radial flow turbine 128 is free to rotate about the protrusion, and the directional aperture plate 126 is configured to be fixed in an orientation normal to the axis of rotation of the radial flow turbine 128. The directional aperture plate 126 includes a generally planar body comprising a plurality spaced apart flow holes configured to provide passage therethrough for the fluid. The flow holes have central, longitudinal axes oriented tangential to the flow of the fluid received thereby and/or the axis of rotation of the radial flow turbine 128.

The radial flow turbine 128 includes a body having distinct chambers configured to receive the flow of the fluid from the directional aperture plate 126 and rotate about the central axis of rotation in response to receiving the flow of the fluid from the directional aperture plate 126. The body of the radial flow turbine 128 includes a segmented, circular wall having a geometric center point thereof corresponding with the central axis of rotation of the radial flow turbine 128. Radial walls extend in radial directions from the center point toward the sidewall of the turbine chamber 130. In the example presented in FIG. 4, the radial flow turbine 128 includes seven radial walls that are fixed to a radially interior side of the circular wall and one free-standing radial wall that is located in a segmented portion of the radial flow turbine 128 and therefore does not directly contact the circular wall. The free-standing radial wall is fixed to adjacent radial walls between lower ends thereof. With this configuration, the radial flow turbine 128 may be described as including six closed chambers and two open chambers, wherein the closed chambers are defined between pairs of adjacent radial walls the are fixed to the circular wall and the open chambers are defined between one of the radial walls fixed to the circular wall and the free-standing radial wall.

During operation, the flow of fluid enters the radial flow turbine assembly via the fluid inlet 120. As the fluid passes through the holes in the directional aperture plate 126, the flow is directed in tangential directions relative to the axial rotation of the radial flow turbine 128. The flow of the fluid enters the distinct chambers of the radial flow turbine 128 and contacts the radial walls thereof resulting in rotation of the radial flow turbine 128. As the radial flow turbine 128 rotates, the circular wall thereof intermittently blocks the outlet apertures in the sidewall of the turbine chamber 130 adjacent thereto. That is, the closed chambers impede flow of the fluid through the outlet apertures whereas the open chambers allow passage of the fluid through the outlet apertures. In the example presented in the figures which includes five, equally spaced apart outlet apertures in the sidewall of the turbine chamber 130, the radial flow turbine 128 is configured to block three or four of the outlet apertures and simultaneously allow passage through one or two of the outlet apertures, depending on the rotational position of the radial flow turbine 128 relative to the outlet apertures.

The operation of the radial flow turbine assembly described above generates a pulsating flow of the fluid and simultaneously increasing a pressure of the fluid. The pulsating flow is directed through the outlet apertures to the corresponding fluid channels 134 and therethrough to the respective nozzles 136. In various embodiments, the nozzles 136 are arranged in a non-linear array in a manner that is sufficient to further increase the pressure of the fluid prior to being sprayed from the nozzles 136.

The fluid inlet 120 may receive the fluid from various sources. In some embodiments, the fluid is fresh water, salt water, or treated water comprising one or more treatment chemicals (e.g., pool water comprising chlorine). In some embodiments, the fluid may be a cleaning solution comprising a cleaning solvent. In some embodiments, the fluid inlet 120 is configured to couple with and receive the fluid from a hose, such as a garden hose coupled to a water spigot. In some embodiments, the fluid inlet 120 is configured to receive pool water from a residential or commercial pool. In various embodiments, the apparatus is configured to rely solely on the fluid pressure of the source of the fluid and does not require a pump or other device configured to increase the fluid pressure. In some embodiments, the fluid pressure provided from the source may be 100 psi (about 690 kPa) or less, such as 75 psi (about 520 kPa) or less, 50 psi (about 350 kPa) or less, or 40 psi (about 275 kPa) or less.

In various embodiments, the housing 102 includes a hydrodynamic exterior shape configured to provide a beneficial effect in response to movement thereof while submerged in a body of fluid. For example, the housing 102 may include an exterior shape configured to reduce resistance by the fluid during movement of the housing 102. In various embodiments, the exterior shape may be configured to produce a force toward the bottom of the housing 102, that is, toward the surface on which the housing 102 is cleaning, in response to fluid flow over the housing 102. In one embodiment, the exterior shape of the housing 102 mimics an exterior shape of a head of a hammerhead shark and thereby produces the downward force in response to movement of the housing 102 through the fluid.

The apparatus 100 provides for a nonlimiting method of cleaning the surface with the fluid. The method may include locating the apparatus 100 on the surface, providing a flow of the fluid from a source of the fluid to the fluid inlet 120 of the housing 102 of the apparatus 100, directing the flow of the fluid from the fluid inlet 120 to the radial flow turbine assembly and producing a pulsating flow of the fluid with therewith, directing the pulsating flow of the fluid to one or more of the nozzles 136 of the housing 102 through the fluid channels 134, and discharging the pulsating flow of the fluid as a spray from the housing 102 via the one or more nozzles 136 such that the spray contacts the surface.

The method may include manually moving the apparatus 100 relative to the surface with an elongated pole coupled to the housing 102. Moving the apparatus 100 may include rolling the housing 102 on the wheels 118 thereof over the surface. In some embodiments, the method may include coupling the fluid inlet 120 to a hose and providing the fluid therethrough from the source.

Figure 7:
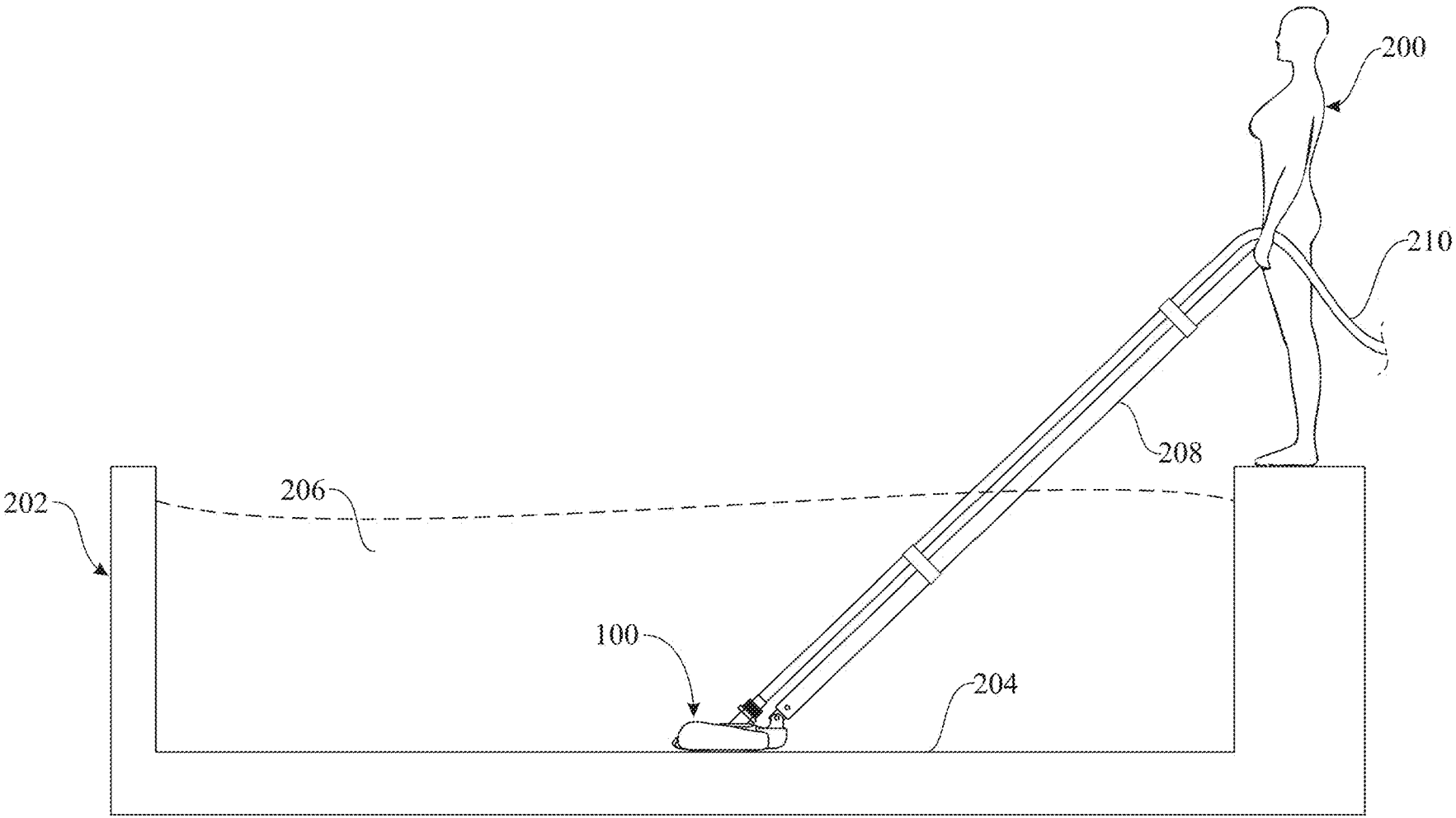
FIG. 7 presents a side view illustrating a method of using the apparatus of FIG. 1 to clean a portion of a swimming pool.

FIG. 7 presents a nonlimiting example of the method in which a user 200 is cleaning a surface 204 of a pool 202 filled with pool water 206. The user 200 is standing outside of the pool 202 while the housing 102 of the apparatus 100 is submerged in the pool water 206. The user 200 may manually move the housing 102 with a pole 208 and a fluid is provided to the housing 102 via a hose 210. With this arrangement, the user 200 is able to clean the surface 204 of the pool 202 with reduced effort relative to, for example, conventional pool brushes.

Alternative embodiments are contemplated in addition the embodiments(s) shown and/or described herein. For example, the apparatus 100 may be configured to be self-propelled on the wheels 118, for example, via use of a motor. As another example, the apparatus 100 may include or be functionally coupled with a pump configured to increase the pressure of the fluid discharged thereby.

The apparatus 100 and its components may be formed of various materials including certain polymeric, ceramic, metallic, and composite materials.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. An apparatus for cleaning a surface with a fluid, the apparatus comprising:

a housing;

a fluid inlet connector coupled to the housing, the fluid inlet connector defining a fluid inlet configured to receive a flow of fluid from a source of fluid;

a radial flow turbine disposed within the housing and configured to receive the flow of fluid from the fluid inlet, the radial flow turbine rotatably mounted about an axis of rotation to rotate and produce a pulsating flow of fluid;

one or more fluid channels each configured to receive the pulsating flow of fluid from the radial flow turbine; and one or more nozzles each configured to receive the pulsating flow for fluid from a corresponding one of the one or more fluid channels and discharge a pressurized spray of fluid from the housing.

2. The apparatus of claim 1, wherein the housing is hydrodynamically shaped to reduce resistance during movement over a submerged surface.

3. The apparatus of claim 1, further comprising a plurality of wheels rotatably coupled to the housing to support and enable movement of the housing over the surface.

4. The apparatus of claim 1, wherein the fluid inlet connector includes a cap mountable relative to the housing, the cap having the fluid inlet.

5. The apparatus of claim 1, including a directional aperture plate mounted adjacent the radial flow turbine, the directional aperture plate configured to direct the flow of the fluid received from the fluid inlet in a tangential direction.

6. The apparatus of claim 5, wherein the directional aperture plate includes a plurality of spaced apart flow holes, their central, longitudinal axes oriented tangential to the flow of fluid received from the fluid inlet.

7. The apparatus of claim 1, wherein the housing further comprises an opening at its top and a cover attachable to the housing for covering the opening.

8. The apparatus of claim 1, further comprising a pole connection adapted to releasably couple to an elongated pole for manual movement of the apparatus.

9. The apparatus of claim 8, wherein the pole connection includes a swivel joint to allow pivoting movement of the apparatus.

10. The apparatus of claim 1, further including a turbine chamber, the radial flow turbine being disposed in the turbine chamber, the turbine chamber having outlet apertures to direct the pulsating fluid flow to the one or more fluid channels.

11. The apparatus of claim 10, wherein the radial flow turbine includes a segmented, circular wall having a center point corresponding with the axis of rotation, configured to intermittently block the outlet apertures of the turbine chamber as the radial flow turbine rotates.

12. The apparatus of claim 1, wherein the one or more nozzles are configured to produce a spiraling fluid spray for improved cleaning action.

13. The apparatus of claim 1, wherein the radial flow turbine comprises distinct chambers, the distinct chambers configured to receive the flow of fluid from the fluid inlet.

14. The apparatus of claim 1, wherein the fluid inlet connector is configured to releasably couple with a hose.

15. The apparatus of claim 1, the one or more nozzles includes a plurality of nozzles.

16. An apparatus for cleaning a surface with a fluid, the apparatus comprising:

a hydrodynamically shaped housing configured for movement over a submerged surface;

a fluid inlet connector connectable to the housing, the fluid inlet connector defining a fluid inlet configured to receive a flow of fluid from a source of fluid;

a radial flow turbine disposed within the housing and configured to receive the flow of fluid from the fluid inlet, the radial flow turbine rotatably mounted about an axis of rotation to rotate and produce a pulsating flow of fluid;

a pole connection adapted to releasably couple to an elongated pole for manual movement of the housing, wherein the pole connection includes a swivel joint to allow pivoting movement relative to the housing;

one or more fluid channels each configured to receive the pulsating flow of fluid from the radial flow turbine; and one or more nozzles each configured to receive the pulsating flow for fluid from a corresponding one of the one or more fluid channels and discharge a pressurized spray of fluid from the housing.

17. The apparatus of claim 16, further comprising a plurality of wheels rotatably coupled to the housing to support and enable movement of the housing over the surface.

18. An apparatus for cleaning a surface with a fluid, which comprises:

a housing defining a plurality of nozzles;

a cap coupled to the housing, the cap defining a fluid inlet configured to receive fluid from a fluid source;

a turbine chamber defining a plurality of chamber outlet ports;

a radial flow turbine mounted within the turbine chamber, the radial flow turbine defining a plurality of chambers configured to receive the fluid from the fluid inlet and configured to rotate about an axis of rotation and produce a pulsating fluid flow for distribution through the chamber outlet ports of the turbine chamber; and a plurality of fluid channels coupled to the chamber outlet ports and in fluid communication with the nozzles of the housing, the fluid channels configured to receive the pulsating fluid flow and direct the pulsating fluid flow to the nozzles of the housing wherein the nozzles discharge the pulsating fluid flow as a pressurized spray to facilitate cleaning of a submerged surface.

19. The apparatus according to claim 18, including a directional apertured plate mounted adjacent the radial flow turbine, the directional apertured plate including one or more openings, the one or more openings arranged about an axis which is tangential to the axis of rotation of the radial flow turbine to direct the fluid from the fluid inlet into the chambers of the radial flow turbine at a tangential angle to cause rotation of the radial flow turbine.

20. The apparatus according to claim 19, wherein the radial flow turbine includes a segmented sidewall, and wherein at least one of the chambers includes an opening in the segmented sidewall to define at least one open chamber, wherein, during rotation of the radial flow turbine, the fluid is distributed through the at least one open chamber and out at least one chamber outlet port aligned with the at least one open chamber.

* * * * *